US009763530B2

(12) United States Patent
Caccavo et al.

(10) Patent No.: US 9,763,530 B2
(45) Date of Patent: Sep. 19, 2017

(54) APPARATUS AND METHOD FOR WINDOW TREATMENT MANAGEMENT

(71) Applicants: Laurie Ann Caccavo, Rumson, NJ (US); Elaine Katherine Espinosa, Raleigh, NC (US); Frank Vincent Caccavo, Jr., Rumson, NJ (US)

(72) Inventors: Laurie Ann Caccavo, Rumson, NJ (US); Elaine Katherine Espinosa, Raleigh, NC (US); Frank Vincent Caccavo, Jr., Rumson, NJ (US)

( * ) Notice: Subject to any disclaimer, the term of this patent is extended or adjusted under 35 U.S.C. 154(b) by 232 days.

(21) Appl. No.: 14/248,370

(22) Filed: Apr. 9, 2014

(65) Prior Publication Data

US 2015/0289702 A1 Oct. 15, 2015

(51) Int. Cl.
*A47H 19/00* (2006.01)
*A47H 13/16* (2006.01)

(52) U.S. Cl.
CPC ..... *A47H 19/00* (2013.01); *A47H 13/16* (2013.01)

(58) Field of Classification Search
CPC ..... A47H 13/14; A47H 13/16; A47H 19/00; A47H 99/00; A47H 1/04; A47H 1/18; A47H 5/00; A47H 13/00
USPC ..... 160/405, 395, 349.2, 349.1, 340, 341, 160/330
See application file for complete search history.

(56) References Cited

U.S. PATENT DOCUMENTS 1,532,566 A 4/1925 Young
2,123,413 A * 7/1938 Geller ..... A47H 23/08 160/237
2,563,306 A * 8/1951 Burrage ..... A47H 19/00 160/349.2
2,584,205 A * 2/1952 Hicks ..... A47H 13/16 160/348
2,622,675 A * 12/1952 Jitomir ..... A47H 23/02 160/349.2
2,782,849 A * 2/1957 Sadloski ..... A47H 19/00 16/87.4 R
2,840,412 A 6/1958 Lancaster
(Continued)

FOREIGN PATENT DOCUMENTS

CN 202932689 U 5/2013

OTHER PUBLICATIONS

Building Sport Kites, Available Feb. 7, 2006, Accessed Jun. 12, 2016 from www.steadywinds.com/kitebuildingsportkites.*
(Continued)

*Primary Examiner* — Katherine Mitchell
*Assistant Examiner* — Jeremy Ramsey
(74) *Attorney, Agent, or Firm* — Maldjian Law Group LLC

(57) ABSTRACT

Embodiments of the present disclosure provide an apparatus and method for window treatment management. The apparatus may include a material strip and a pulling device. The material strip may include a hook threaded onto at least one end of the material strip and a plurality of loops stitched longitudinally onto the material strip. The pulling device may be utilized for pulling the material strip through the hook from a first end opening of a rod pocket of a window element to a second end opening thereof. Herein, the hook may be connected to one of the loops to create a securing loop around the window element when the material strip is exposed at the second end opening.

19 Claims, 8 Drawing Sheets

(56) References Cited

U.S. PATENT DOCUMENTS

| | | | | |
|---|---|---|---|---|
| 3,754,589 | A * | 8/1973 | Heimberg | A47H 19/00 160/349.2 |
| 5,688,011 | A * | 11/1997 | Gulley | B66C 1/18 294/74 |
| D454,235 | S | 3/2002 | Kaplan | |
| 8,505,683 | B1 | 8/2013 | Dirrig | |
| D703,878 | S * | 4/2014 | Hieber | D30/152 |

OTHER PUBLICATIONS

International Preliminary Report on Patentability for International Application No. PCT/US2015/021907, mailed Jun. 15, 2015, 2 Pages.

Notification of Transmittal of Translation of the International Preliminary Report on Patentability (Chapter I or Chapter II) along with Written Opinion of the International Searching Authority for International Application No. PCT/US2015/021907, mailed Jun. 15, 2015, 5 Pages.

International Preliminary Report on Patentability mailed Oct. 20, 2016, from corresponding International Application No. PCT/US15/021907 (6 pages total).

* cited by examiner

APPARATUS AND METHOD FOR WINDOW TREATMENT MANAGEMENT

BACKGROUND

Field of the Invention

The present invention generally relates to window treatments, and in particular, to an apparatus and a method for window treatment management.

Description of Related Art

Homeowners and professional businesses such as hotels, spas, salons, and the like utilize window treatments such as curtains, sheers, drapes, valances and so on to improve the aesthetic appearance and value of the living space. A common challenge interior designers and users face is the inability to manage the window treatments. For example, one attractive style for window treatments is to "pin back" or keep open the window treatment on opposing sides of the window or design element.

Generally, users attempt to manage this issue by using rubber bands and safety pins. Specifically, an attempt to contain the window treatment (e.g., keep it open) includes placement of a snug rubber band on a curtain rod and around the window treatment and securing it with a safety pin. However, such conventional solutions for window treatment management fail because of deterioration of rubber band and further due to inconvenience and inability to install the window treatment securely. Moreover, such attempts demand for significant time of the installer without providing the desired result.

Thus, based on the aforementioned, there is a need for an apparatus and a method for managing a window treatment to allow the installer to achieve symmetry and to substantially eliminate sagging and spreading of window elements. Further, the apparatus and the method for managing a window treatment should be able to enhance the aesthetic appeal of the window element and overall decoration. Furthermore, the apparatus and the method should be convenient and efficient without requiring significant time for installation thereof.

SUMMARY

Embodiments for the present invention provide an apparatus for managing a window treatment. The apparatus may include a material strip having a hook threaded onto at least one end of the material strip. Further, the material strip may include a plurality of loops stitched longitudinally onto the material strip. The apparatus may further include a pulling device for pulling the material strip through the hook from a first end opening of a rod pocket of a window element to a second end opening of the rod pocket to expose the material strip at the second end opening. Herein, the hook is connected to one of the plurality of the loops to create a securing loop around the window element, when the material strip is exposed at the second end opening.

Hereinabove, an unhooked end (that is not hooked to the pulling device) of the material strip may be held firmly at the first end opening of the rod pocket when the material strip is pulled from the first end opening to the second end opening of the rod pocket. Further, the hook is disconnected from the pulling device when the material strip is exposed at the second end opening and connects to the one of the plurality of loops. The loop from the plurality of the loops is selected based on an arrangement required for the window element. Herein, the window element may include, but is not limited to, a curtain, a drape, sheers, and a valance.

Further, embodiments of the present invention provide a curtain corrector for managing a window treatment. The curtain corrector may include a material strip comprising a hook end having a hook attached thereto. Further, the curtain corrector may include a pulling device slidable through a rod pocket of a curtain, the pulling device connected to the hook of the material strip and slid from a first end opening of the rod pocket to a second end opening of the rod pocket to expose the hook at the second end opening. Herein, the exposed hook is disconnected from the pulling device to join an opposite end of the material strip for creating a securing loop around the curtain.

Furthermore, embodiments of the present invention provide a method for managing a window treatment. The method may include sliding a pulling device through a first opening of a rod pocket of a window element. Herein, a first end of the pulling device is connected to a hook threaded at a hook end of a material strip. The pulling device may be slid through a second end thereof. Further, the method may include pulling out the first end of the pulling device from a second opening of the rod pocket to expose the hook of the material strip at the second opening. Furthermore, the method may include detaching the first end of the pulling device from the exposed hook at the second opening of the rod pocket. The method may further join the hook end to an opposite end of the material strip by fixing the exposed hook into one of a plurality of loops of the material strip, thereby creating a securing loop around the window element and thus managing the window treatment.

Embodiments of the present invention provide a number of advantages that may include an apparatus and a method for window treatment to obtain a uniform and symmetrical look. Further, the apparatus and the method eliminate sagging or separation of a window treatment, such as a window element including a curtain, a drape, a sheer, a valance and the like. Specifically, the apparatus may include a material strip and a pulling device to pull the material strip from one end opening of a rod pocket of the window element to another end opening of the rod pocket for creating a securing loop around the window element. Due to this, the window element may be adjusted to a desired width. Further, the apparatus and the method may facilitate a complete installation and improve an aesthetic appeal of the window treatment and to enhance overall decorative effect thereof. Further, embodiments of the present invention provide a curtain corrector specifically for curtains including the material strip and the pulling device to create securing loop around the curtain.

These and other advantages will be apparent from the disclosure of the embodiments of the present invention contained herein.

The preceding is a simplified summary of embodiments of the present invention to provide an understanding of some aspects of the present invention. This summary is neither an extensive nor an exhaustive overview of the present invention and its various embodiments. It is intended neither to identify key or critical elements of the present invention nor to delineate the scope of the present invention but to present selected concepts of the present invention in a simplified form as an introduction to the more detailed description presented below. As will be appreciated, other embodiments of the present invention are possible utilizing, alone or in combination, one or more of the features set forth above or described in detail below.

BRIEF DESCRIPTION OF THE DRAWINGS

The above and still further features and advantages of the present invention will become apparent upon consideration of the following detailed description of embodiments thereof, especially when taken in conjunction with the accompanying drawings, and wherein.

Figure 1:
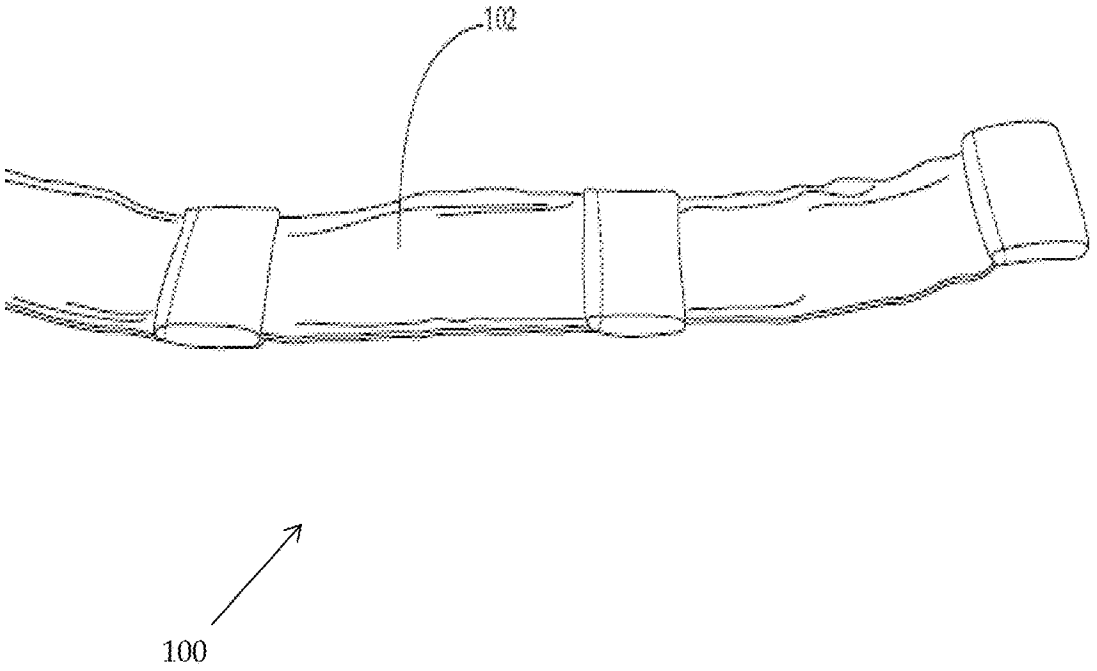
FIG. 1 is an exemplary representation of a material strip, in accordance with an embodiment of the present invention.

The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include," "including," and "includes" mean including but not limited to. To facilitate understanding, like reference numerals have been used, where possible, to designate like elements common to the figures.

DETAILED DESCRIPTION

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

The term "a" or "an" entity refers to one or more of that entity. As such, the terms "a" (or "an"), "one or more" and "at least one" can be used interchangeably herein. It is also to be noted the terms "comprising", "including", and "having" can be used interchangeably.

The present disclosure provides embodiments of an apparatus and a method for window treatment management to obtain a uniform and symmetrical look of the window treatment including a window element like a curtain, a drape, a sheer, and a valance. Further, embodiments of the present invention eliminate sagging or separation of the window treatment. Specifically, the apparatus may contain and adjust window treatment to facilitate a complete installation and improve an aesthetic appeal of the decorative/functional window treatment.

The apparatus may include, but is not limited to, a material strip with a hook and a plurality of loops together with a pulling device, such as a drawing rod to pull out the material strip from a rod pocket of the window element. Further, the present invention may perform a function to correct/manage a window element such as a curtain. Thus, a device or a combination of components that performs this functionality of correcting or managing the curtain may hereinafter be referred to as a 'curtain corrector.' The curtain corrector may perform a method of attaching and securing a curtain to eliminate sagging or closing of the curtain. The curtain corrector may be utilized for window treatment for all curtain sizes and shapes of rods of the curtains.

Specifically, the curtain corrector for a window treatment may include a material strip having a hook end for attaching a hook thereto. Further, the curtain corrector may include a pulling device that may be slidable through a rod pocket of the curtain. The pulling device may be connected to the hook of the material strip and slid from a first end opening of the rod pocket to a second end opening of the rod pocket to expose the hook (attached to the material strip) at the second end opening. Herein, the exposed hook may be disconnected from the pulling device to join an opposite end of the material strip for creating a securing loop around the curtain. The curtain corrector may be understood in light of the apparatus and method described below with respect to the description of drawings.

Referring now to FIG. 1 that illustrates an exemplary material strip 100, in accordance with an embodiment of the present invention. The material strip 100 may be a flexible or an elastic strip that may be utilized to secure a window element such as a curtain, a drape, a sheer or a valance. The material strip 100 may be of various lengths and may be made up of a material 102 such as fabric, plastic, hook and loop, woven yarn, ribbon, or twill tape, and the like.

The material strip 100 may include, but is not limited to, a hook (see FIG. 2), such as a lingerie hook, attached via a sewn loop to the material strip 100. In an embodiment, the material strip 100 may include a hook at each distal end thereof. Further, the material strip 100 may include a plurality of loops that may be stitched longitudinally onto the material strip 100. The plurality of loops may be stitched onto the material strip 100 for the purpose of adjusting and fixing the window element such as a curtain/drape.

The window element may be adjusted by utilizing a pulling device (see FIG. 5) that may pull out one end of the material strip 100 from one of two openings of a rod pocket of the window element, such as a curtain. The one end that is pulled out from the opening of the rod pocket may be joined to another end of the material strip 100 that may be at another opening of the rod pocket and thus the material strip 100 may be secured around the window element to secure the window element and thus eliminate sagging or the curtain closing unwillingly, thereof.

Specifically, the one end of the material strip 100 that is pulled out from the rod pocket may have the hook that may be first connected to the pulling device for enabling the pulling device to pull the material strip 100 out from the rod pocket. Further, once the pulling device exposes the material strip 100 out from the opening at one end of the rod pocket, the hook of the material strip 100 may be disconnected from the pulling device. Further, the hook may connect to one of the plurality of loops of the material strip 100 in a way such that the material strip 100 secures or surrounds the window element to secure the window element and thus eliminate sagging or spread of the window element.

The material strip may secure the window element either before or after the window element is mounted on a window rod. Herein, the window rod may be a rod (such as a metallic rod or a plastic rod) to tie a window element thereon/thereto. Further, the concept of the pulling device is described further in conjunction with FIG. 5.

Figure 2:
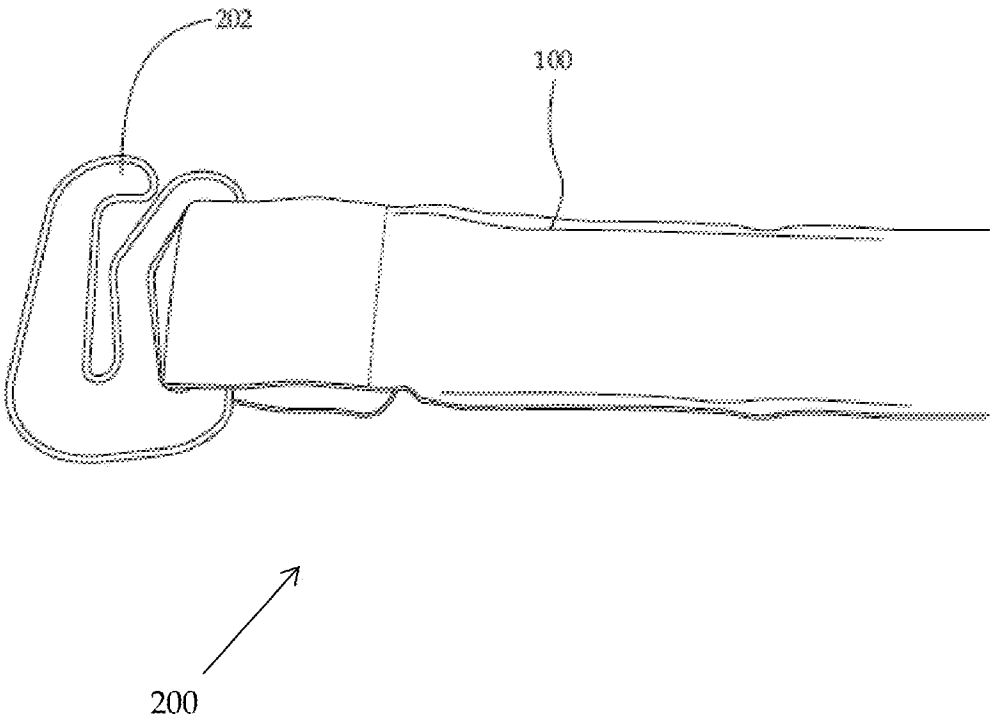
FIG. 2 depicts an exemplary hook portion of the material strip, in accordance with an embodiment of the present invention.

FIG. 2 depicts an exemplary hook portion 200 of a material strip, such as the material strip 100, in accordance with an embodiment of the present disclosure. The hook portion 200 of the material strip 100 may include a hook 202 threaded onto one side of a material strip 100. In an embodiment, the hook 202 may be threaded on each distal end of the material strip 100. Further, as depicted, the hook 202 may be a lingerie hook that may be attached via a sewn loop to the material strip. Further, the hook 202 may be made up of various materials such as plastic, metal, and the like.

Figure 5:
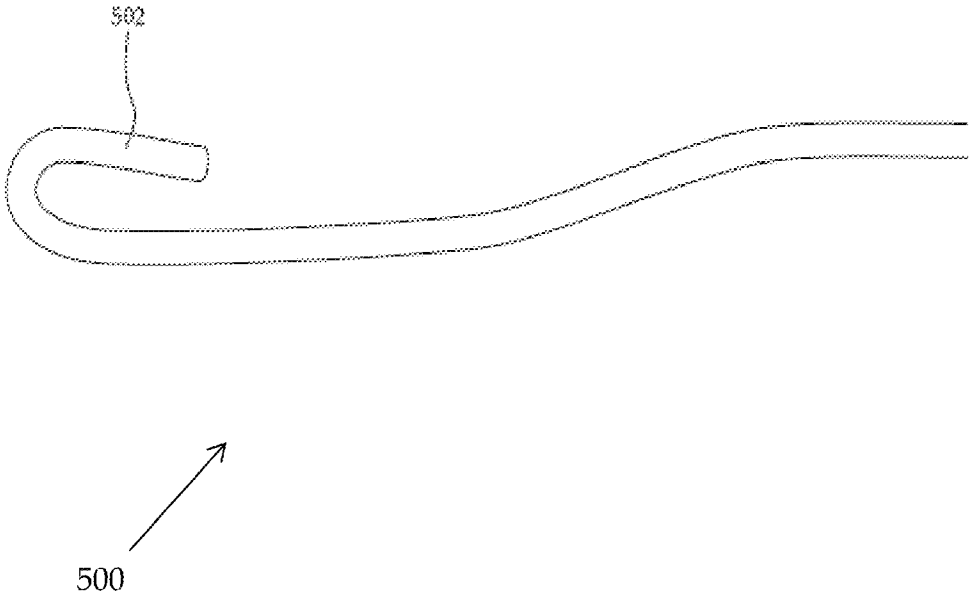
FIG. 5 illustrates a pulling device that is used in combination with the material strip to secure a window element, in accordance with an embodiment of the present invention.

In an embodiment of the present disclosure, the hook 202 may be utilized by a pulling device (as shown in FIG. 5) to pull the material strip 100 from a first end opening of a rod pocket of a window element (such as a curtain) to a second end opening of the rod pocket. Herein, the material strip 100 may be pulled from a hook end (having a hook 202) thereof. The pulling device may be connected to the hook 202 and other end (may be an unhooked end that is not hooked) of the material strip may be held firmly outside the first end opening of the rod pocket.

Once the hook 202 is exposed at the second end opening of the rod pocket, the hook 202 may be disconnected from the pulling device. Further, the hook 202 may be connected to one of a plurality of loops of the material strip 100 to make a securing loop around the window element. The hook 202 may be connected to one of the plurality of loops based on a type (tight or loose) of securing required around the window element. For example, the window element may be secured tightly by fastening the hook 202 to a loop that is sewn far from the other distal end (unhooked end, that may be held outside of the first end opening) of the material strip 100.

Figure 3:
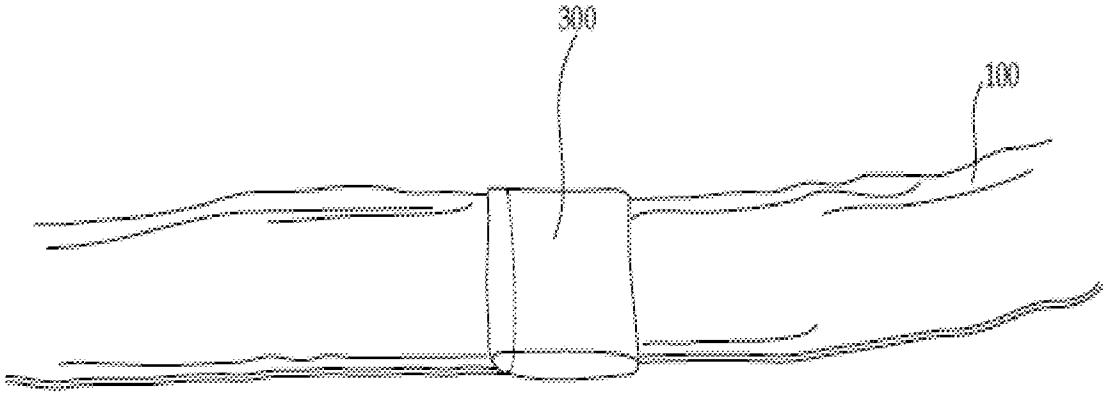
FIG. 3 depicts an exemplary loop of a plurality of loops stitched onto the material strip, in accordance with an embodiment of the present invention.

FIG. 3 depicts an exemplary loop 300 of a plurality of loops stitched onto the material strip 100, in accordance with some embodiments of the present disclosure. As depicted, the loop 300 may be sewn onto the material strip 100 for the purpose of adjusting and fixing a window element (such as, but is not limited to, a curtain). Further, the material strip 100 may include a plurality of loops threaded onto the material strip 100.

The plurality of loops may include a loop that is sewn onto the material strip 100 to attach a hook, such as the hook 202 (as depicted in FIG. 2) to the material strip 100. Further, additional loops of the plurality of loops may be stitched longitudinally onto the material strip 100. In an embodiment, a first loop may be at six inches and then further loops may be at an interval of two inches up to twenty-four inches in total length of the material strip 100.

Specifically, the hook 202 of the material strip 100 may be fastened inside a loop of the plurality of loops of the material strip 100 for purpose of securing the window element there between. Herein, the hook 202 may join to the loop stitched to an opposite side (that is opposite to the hook 202) of the material strip 100. Further, the hook 202 may join the loop (at an end opposite to the hook) when a hook end of the material strip 100 is pulled out of a rod pocket of a window element. The material strip 100 may be pulled out of the rod pocket through a pulling device (not shown) connected to the hook 202 attached to the material strip 100. The material strip may be of various types, as depicted in FIG. 4.

Figure 4:
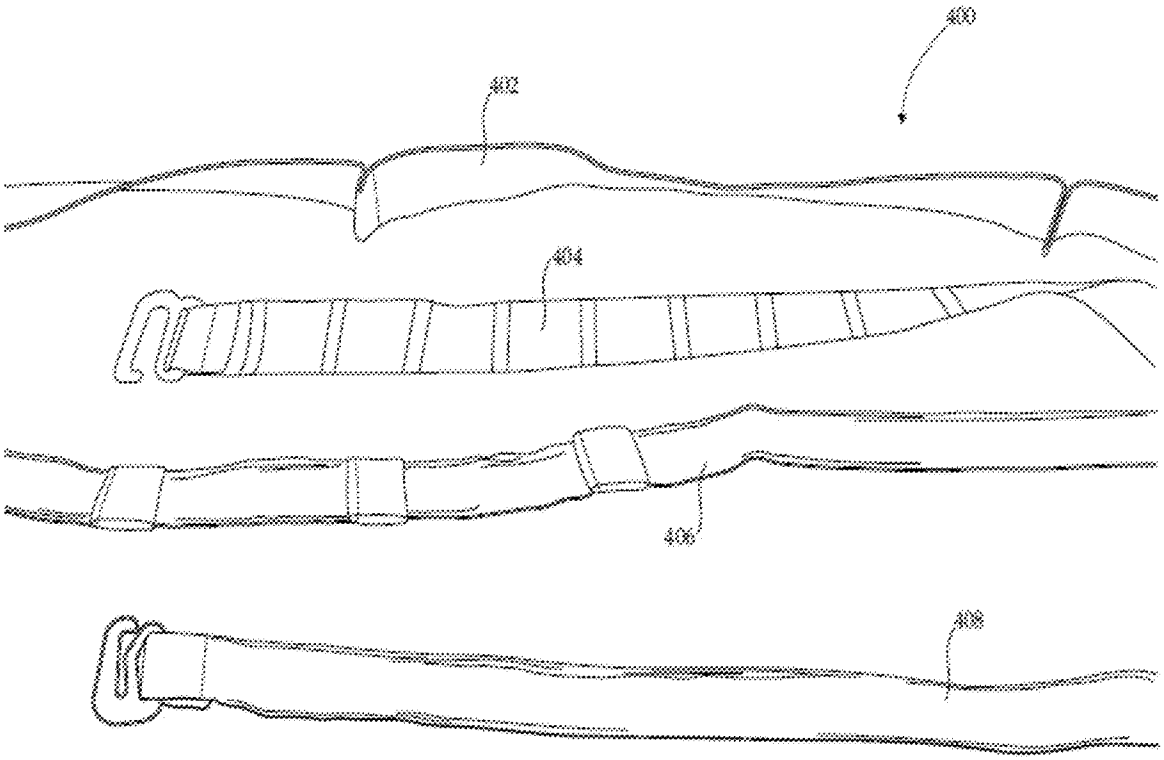
FIG. 4 illustrates various types of material strips, in accordance with an embodiment of the present invention.

FIG. 4 illustrates various types 400 of material strips, in accordance with some embodiments of the present disclosure. As depicted, a material strip, such as the material strip 100, may be of various types, such as a material strip type 402, a material strip type 404, a material strip type 406 and a material strip type 408. Specifically, the material strip may be of fabric, plastic, hook and loop material, woven yarn, ribbon, or twill tape.

Each type of the material strip 100 may be utilized together with a pulling device (explained further in conjunction with FIG. 5) to secure a window element, such as a curtain, a drape, a sheer, a valance and the like. Alternatively, if the material strip 100 is made of hook and loop material, e.g., VELCRO, the hook 202 may be optional as the material strip may be secured utilizing the securing means of the hook and loop material. The window element may be secured to eliminate spread and sagging thereof. The material strip 100 may be elastic in nature or flexible to make a loop around the window element for securing the window element. For example, the material strip 100 may include a hook end having a hook, such as the hook 202, attached thereto. Further, the material strip 100 may include a plurality of loops threaded longitudinally onto the material strip 100.

Referring to FIG. 5, the pulling device 500 may be hooked with the hook of the material strip 100 that may further slide through a rod pocket of the window element. Accordingly, the pulling device 500 may pull the hook end of the material strip 100 and thereby may pull the material strip 100 from first end opening of the rod pocket to a second end opening of the rod pocket. In an embodiment, the pulling device 500 may be pushed towards the second end opening of the rod pocket so as to expose the material strip 100 at the second end opening of the rod pocket. In another embodiment, if the material strip 100 is made of hook and loop material, the hook portion 502 of the pulling device 500 can be secured to the material strip 100 by means of attaching a first end of the material strip around the hook 502 utilizing the features of hook and loop technology.

Another end (unhooked end) of the material strip 100 may be held firmly outside the first end opening of the rod pocket when the pulling device 500 pulls the hook end of the material strip 100 towards the second end opening. On reaching the second end opening of the rod pocket, the hook of the material strip 100 may be disconnected from the pulling device 500 and may then be connected to one of the plurality of the loops (at an opposite unhooked end of the material strip that is not hooked) around the window element and thus may secure the window element to prevent spread and sagging thereof.

FIG. 5 illustrates a pulling device 500 that is used in combination with the material strip, such as the material strip 100, to secure a window element, in accordance with an embodiment of the present disclosure. The pulling device 500 may be a metal rod with an elongated "s" bend at one end and a semi-circle at an opposite end thereof. The elongated "s" bend may be utilized by the pulling device 500 to fasten with a hook, such as the hook 202, of the material strip 100.

In an embodiment, a first end 502 of the pulling device 500 may be fastened with the hook of the material strip 100 and a second end (not shown) may be a smooth and free end of the pulling device 500. The second end of the pulling device 500 may enter into a rod pocket of a window element, such as, but not limited to, a curtain. The pulling device 500 may be pushed inside the rod pocket from a first opening of the rod pocket to a second opening of the rod pocket. In an embodiment, the pulling device 500 may be pushed by a user to slide the pulling device 500 from the first opening to the second opening of the rod pocket. Due to such push inside the rod pocket, the pulling device 500 may slide inside the rod pocket and may pull along the material strip 100 connected to the pulling device 500 through the hook of the material strip 100. Further, an opposite end (unhooked end, that is not hooked) of the material strip 100 may be held firmly outside the first opening of the rod pocket when the material strip 100 is pulled towards the second opening of the rod pocket so as to avoid pulling of both the ends of the material strip 100 inside the rod pocket.

The second end of the pulling device 500 may reach first at the second opening of the rod pocket that may be pushed or pulled out further for pulling a hook end (having the hook) of the material strip 100. The pulling device 500 may be pulled out until the material strip 100 connected to the pulling device 500 (through the hook) is exposed at the second opening of the rod pocket.

Once the material strip 100 is exposed at the second opening, the hook (as exposed at the second opening) may be disconnected from the pulling device 500. Further, the hook may be joined to the opposite unhooked end (held at the first opening) of the material strip 100 by fixing within a loop of a plurality of loops (as described previously in conjunction with FIG. 3) of the material strips 100. The hook (at the second opening) may be connected to the loop of the plurality of loops (at the first opening) to create a secure loop around the window element.

The pulling device 500 may be metal, plastic, glass, wood, cardboard, and so on. Further, the present disclosure may not be considered as limiting to the above-described embodiments and functioning. For example, the material strip 100 may have a hook at each distal end of thereof. Further, these hooks may be connected around the window element for securing the window element to eliminate the spread and sagging thereof.

Figure 6A:
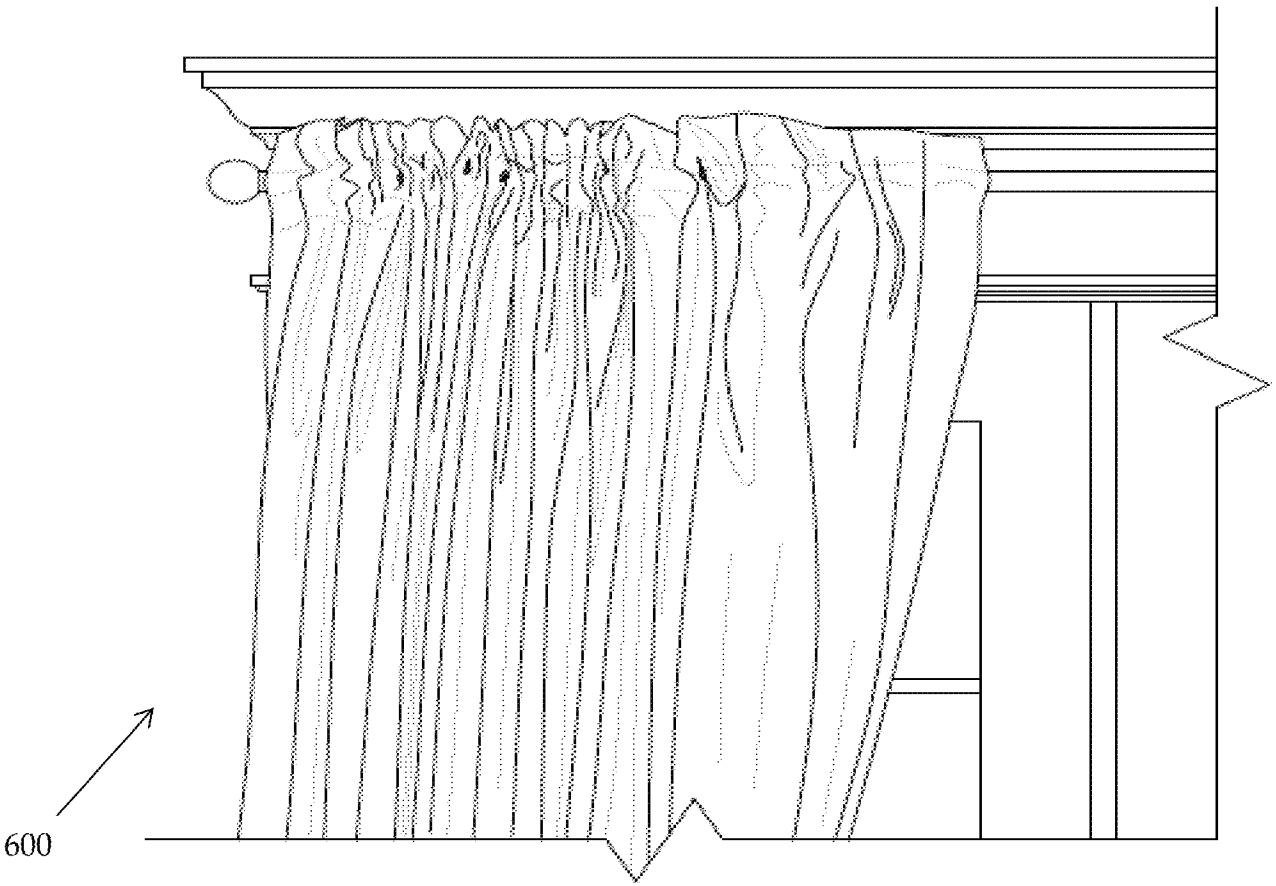
FIG. 6A illustrates cross-sectional view of sagging or closing of a window element.
Figure 6B:
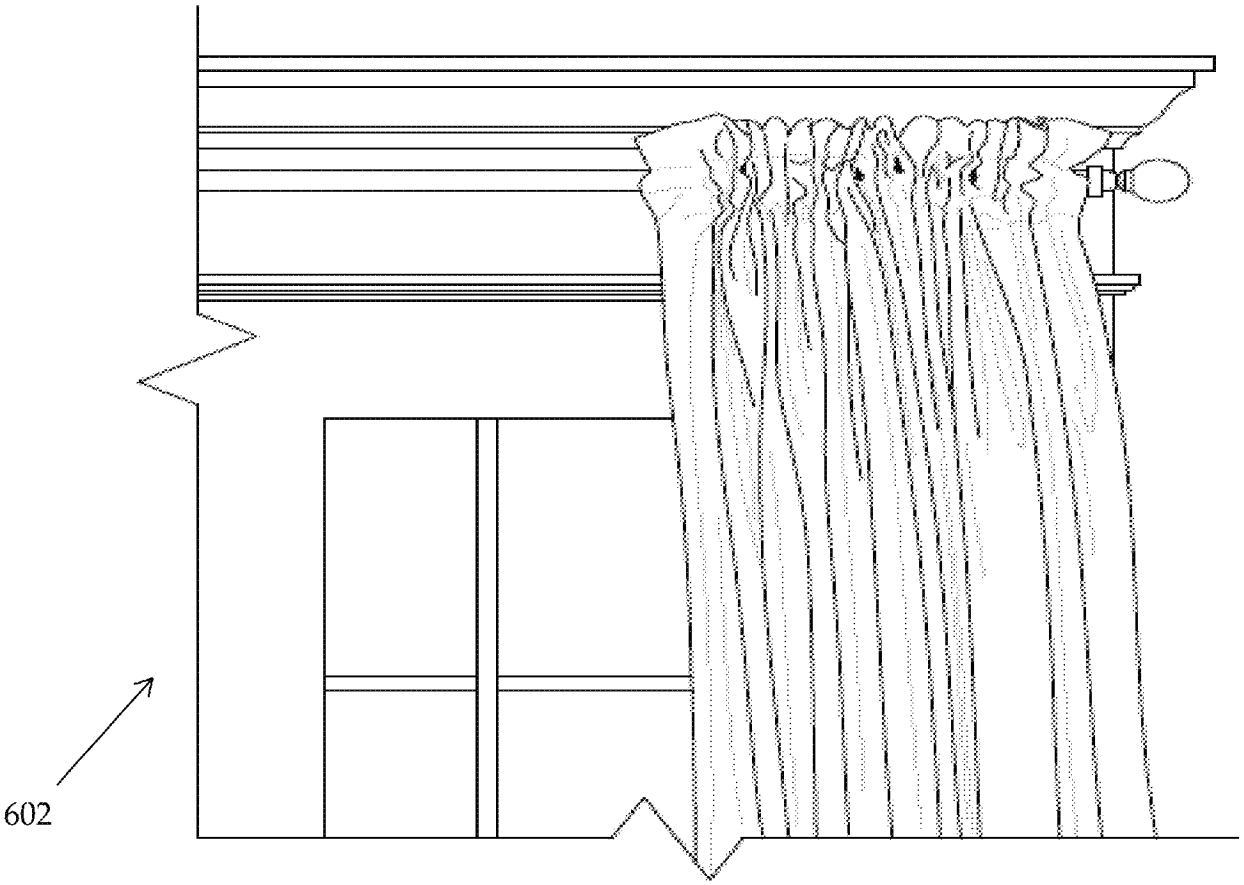
FIG. 6B illustrates cross-sectional view of elimination of sagging of the window treatment, in accordance with an embodiment of the present invention.

FIG. 6A illustrates sagging of a window element such as, a curtain, a drape, a sheer and a valence when the window element is pulled or pushed by a user using the conventional window treatment techniques. In the present disclosure, when a user connects a hook, such as the hook 202 of a material strip, such as the material strip 100, to one of a plurality of the loops (at an opposite unhooked end of the material strip that is not hooked) around the window element by using the pulling device 500, the secured loop around the window element may eliminate sagging or separation of the window element, as shown in FIG. 6B. The present disclosure manages a window treatment that may further enhance the aesthetic appeal of the window element and overall decoration.

Figure 7:
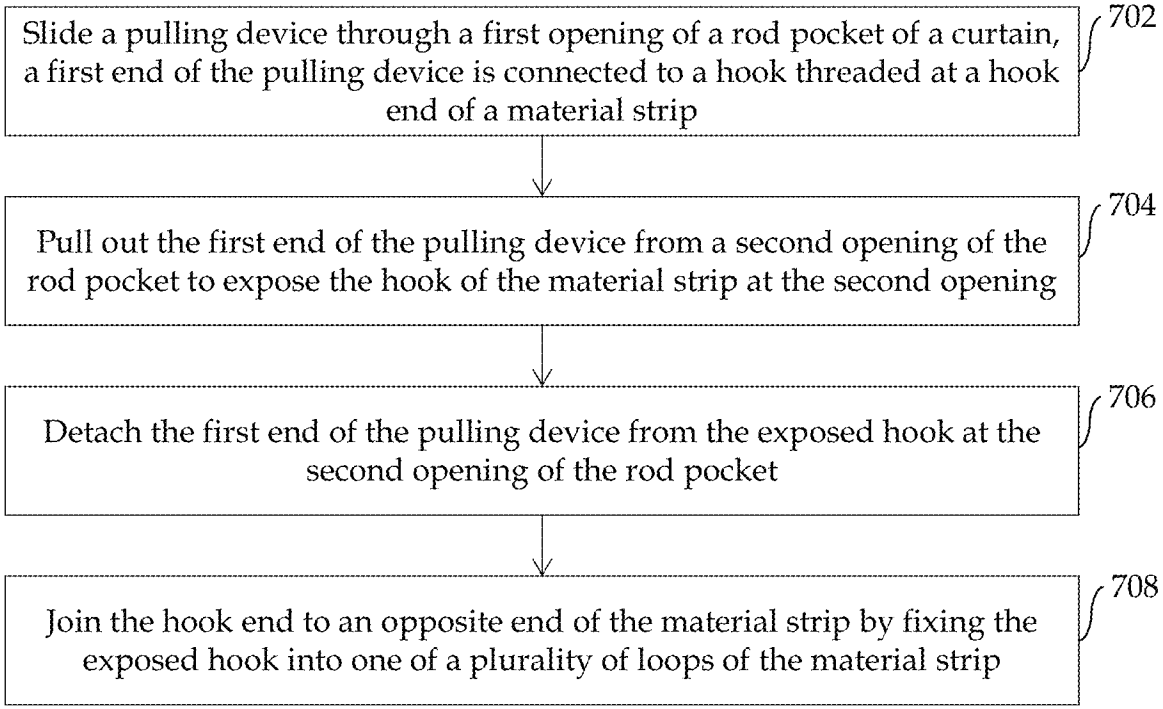
FIG. 7 illustrates a flow diagram of a method for window treatment management, in accordance with an embodiment of the present invention.

FIG. 7 illustrates a flow diagram of a method 700 for window treatment management, in accordance with some embodiments of the present disclosure. The method 700 for window treatment may be understood more clearly when read in conjunction with FIGS. 1 to 6. The order in which the method 700 is performed is not intended to be construed as limitation, and further any number of the method steps may be combined in order to implement the method or an alternative method without departing from the scope of this disclosure.

The method 700 may utilize a material strip, such as the material strip 100, and a pulling device, such as the pulling device 500 for securing a window element, such as (but not limited to) a curtain to eliminate spread and sagging thereof. At step 702, the pulling device may slide through a first opening of a rod pocket of the window element, (such as a curtain). Herein, a first end (such as the first end 502) of the pulling device may be connected to a hook threaded at a hook end of the material strip. Further, herein the pulling device may be slid inside the rod pocket through a second end thereof.

At step 704, the first end of the pulling device may be pulled out from a second opening of the rod pocket to expose the hook of the material strip at the second opening. In an embodiment, the pulling device may be pushed (by a user) towards the second opening of the rod pocket to expose the hook of the materials strip at the second opening of the rod pocket. Herein, an opposite end (that is not hooked to the pulling device) of the material strip may be held firmly outside the first opening of the rod pocket of the window element when the first end of the pulling device is pulled out from the second opening of the rod pocket.

At step 706, the first end of the pulling device may be detached from the exposed hook at the second opening of the rod pocket. Further, at step 708, the hook end of the material strip may be joined to an opposite end (that is not hooked to the pulling device) of the material strip by fixing the exposed hook into one of a plurality of loops of the material strip to create a securing loop around the window element. Herein, the plurality of loops may be stitched longitudinally onto the material strip.

In an embodiment, the material strip 100 and the pulling device 500 may collectively function as a curtain corrector to secure the curtain (or any other window element) for eliminating spread and sagging of the curtain. Thus, the curtain corrector, according to an embodiment of the present disclosure may perform the functionalities as described here above in conjunction with FIGS. 1 to 7 to create securing loop around the curtain to further eliminate spread and sagging thereof.

Further, the method 700 implemented for window treatment management may not be restricted to above-mentioned embodiment of the present disclosure. Further, various embodiments that are explained above in conjunction with FIGS. 1 to 6 may be utilized to implement various method steps to carry out processes that may be implemented as explained hereinabove. Further, the present invention is not limited to above-mentioned embodiments and examples and many other embodiments and examples may be implemented in light of the present invention without departing from the scope of the present invention.

Also, while the flow chart has been discussed and illustrated in relation to a particular sequence of events, it should be appreciated that changes, additions, and omissions to this sequence can occur without materially affecting the operation of the present invention.

A number of variations and modifications of the present invention can be used. It would be possible to provide for some features of the present invention without providing others.

Further, various other embodiments may also be implemented through components provided by the present disclosure. Also, the usage of terminology such as 'first opening' or 'first end opening', 'second opening' or 'second end opening', first end', 'second end' may not be considered a restrictive aspect of the present invention as such terminologies are used just for the purpose of better explanation. Further, many other advantages may be understood in light of the description given above without departing from the scope of the present invention. For example, the present disclosure may provide a solution to eliminate spread or sagging of a window element and thus facilitate an easy installation of the window element without requiring extra time on installer's behalf.

While the foregoing is directed to embodiments of the present invention, other and further embodiments of the present invention may be devised without departing from the basic scope thereof. In particular, it should be appreciated that any element of any embodiments disclosed herein may be combined with any other elements from any other embodiments disclosed herein, in accordance with yet further embodiments of the present invention.

The present invention, in various embodiments, configurations, and aspects, includes components, methods, processes, systems and apparatus substantially as depicted and described herein, including various embodiments, sub-combinations, and subsets thereof. Those of skill in the art will understand how to make and use the present invention after understanding the present disclosure. The present invention, in various embodiments, configurations, and aspects, includes providing apparatus and processes in the absence of items not depicted and/or described herein or in various embodiments, configurations, or aspects hereof, including in the absence of such items as may have been used in previous devices or processes, e.g., for improving performance, achieving ease and reducing cost of implementation.

The foregoing discussion of the present invention has been presented for purposes of illustration and description. The foregoing is not intended to limit the present invention to the form or forms disclosed herein. In the foregoing Detailed Description for example, various features of the present invention are grouped together in one or more embodiments, configurations, or aspects for the purpose of streamlining the disclosure. The features of the embodiments, configurations, or aspects of the present invention may be combined in alternate embodiments, configurations, or aspects other than those discussed above. This method of disclosure is not to be interpreted as reflecting an intention that the claimed invention requires more features than are expressly recited in each claim. Rather, as the following claims reflect, inventive aspects lie in less than all features of a single foregoing disclosed embodiment, configuration, or aspect. Thus, the following claims are hereby incorporated into this detailed description, with each claim standing on its own as a separate preferred embodiment of the present invention.

Moreover, though the description of the present invention has included description of one or more embodiments, configurations, or aspects and certain variations and modifications, other variations, combinations, and modifications are within the scope of the present invention, e.g., as may be within the skill and knowledge of those in the art, after understanding the present disclosure. It is intended to obtain rights that include alternative embodiments, configurations, or aspects to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. An apparatus for window treatment management comprising:

a material strip comprising:

a hook threaded onto at least one hook end of the material strip; and a plurality of loops stitched longitudinally onto the material strip; and a pulling device for pulling the material strip through the hook from a first end opening of a rod pocket of a window element to a second end opening of the rod pocket to expose the material strip and the hook at the second end opening, wherein the hook is connected to one of the plurality of the loops exposed through the first end opening to create a securing loop around the window element, when the material strip is exposed at the second end opening, and wherein the material strip is adjacent to a rod element when both are inserted in the rod pocket.

2. The apparatus of claim 1, wherein the hook is disconnected from the pulling device when the material strip is exposed at the second end opening.

3. The apparatus of claim 1, wherein an unhooked end of the material strip is held at the first end opening of the rod pocket when the material strip is pulled from the first end opening to the second end opening of the rod pocket.

4. The apparatus of claim 1, wherein a first end of the pulling device is connected to the hook and a second end of the pulling device is free.

5. The apparatus of claim 4, wherein the material strip is pulled out from the second end opening by pulling out the pulling device from the second end opening when the second end of the pulling device is visible at the second end opening.

6. The apparatus of claim 1, wherein the pulling device is pushed by a user to slide the pulling device from the first end opening to the second end opening of the rod pocket of the window element.

7. The apparatus of claim 1, wherein the pulling device comprises an elongated 'S' shape having a bend at one end and a semi-circle at another end thereof.

8. The apparatus of claim 1, wherein the material strip comprises a material selected from a group consisting of fabric, plastic, hook-and-loop material, woven yarn, ribbon, twill tape.

9. A curtain corrector for window treatment comprising:

a material strip comprising a hook end having a hook attached thereto; and a plurality of loops stitched longitudinally onto the material strip a pulling device slidable through a rod pocket of a curtain, the pulling device connected to the hook of the material strip and slid from a first end opening of the rod pocket to a second end opening of the rod pocket to expose the hook at the second end opening, wherein the exposed hook is disconnected from the pulling device to join an opposite end of the material strip for creating a securing loop around the curtain and wherein the material strip is adjacent to a rod element when both are inserted in the rod pocket.

10. The curtain corrector of claim 9, wherein the exposed hook is joined to the opposite end of the material strip by fixing into one of the plurality of loops stitched onto the material strip.

11. The curtain corrector of claim 9, wherein the exposed hook joins the opposite end of the material strip when the hook end of the material strip is pulled out of the second end opening of the rod pocket.

12. The curtain corrector of claim 9, wherein the pulling device is slid from the first end opening to the second end opening to pull the hook end of the material strip from the first end opening to the second end opening.

13. The curtain corrector of claim 9, wherein the opposite end of the material strip is held at the first end opening of the rod pocket when the pulling device, connected to the hook, is pulled from the first end opening to the second end opening of the rod pocket.

14. The curtain corrector of claim 9, wherein the material strip comprises a material selected from a group consisting of fabric, plastic, hook-and-loop material, woven yarn, ribbon, twill tape.

15. A method for window treatment management using the apparatus of claim 1 comprising; sliding the pulling device through the first end opening of the rod pocket of the window element, wherein a first end of the pulling device is connected to the hook threaded at the hook end of the material strip, and wherein the pulling device is slid through a second end thereof; pulling out the first end of the pulling device from the second end opening of the rod pocket to expose the hook of the material strip at the second end opening; detaching the first end of the pulling device from the exposed hook at the second end opening of the rod pocket; and joining the hook end to an opposite end of the material strip by fixing the exposed hook into one of the plurality of loops of the material strip, thereby creating a securing loop around the window element.

16. The method of claim 15, wherein the plurality of loops are stitched longitudinally onto the material strip.

17. The method of claim 15, wherein the opposite end of the material strip is held outside the first end opening of the rod pocket.

18. The method of claim 15, wherein the opposite end of the material strip is held firmly when the first end of the pulling device is pulled out from the second end opening of the rod pocket.

19. The method of claim 15 further comprising pushing the pulling device towards the second end opening of the rod pocket to expose the hook of the material strip at the second end opening of the rod pocket.

* * * * *